United States Patent [19]

Kubo et al.

[11] Patent Number: 5,021,316

[45] Date of Patent: Jun. 4, 1991

[54] COATED CARRIERS FOR DEVELOPING ELECTROSTATIC IMAGES

[75] Inventors: Motonobu Kubo, Minoo; Hiroshi Inukai, Takatsuki; Takahiro Kitahara, Suita, all of Japan

[73] Assignee: Daikin Industries, Ltd., Osaka, Japan

[21] Appl. No.: 418,155

[22] Filed: Oct. 6, 1989

[30] Foreign Application Priority Data

| | | | |
|---|---|---|---|
| Oct. 6, 1988 | [JP] | Japan | 63-253576 |
| Oct. 13, 1988 | [JP] | Japan | 63-258906 |
| Dec. 21, 1988 | [JP] | Japan | 63-324486 |
| Apr. 20, 1989 | [JP] | Japan | 1-101475 |
| Aug. 11, 1989 | [JP] | Japan | 1-208925 |

[51] Int. Cl.[5] ..... G03G 9/13

[52] U.S. Cl. ..... 430/108; 428/407

[58] Field of Search ..... 430/108; 428/407

[56] References Cited

U.S. PATENT DOCUMENTS

| | | | |
|---|---|---|---|
| 4,614,700 | 9/1986 | Yamamoto et al. | 430/108 X |
| 4,954,409 | 9/1990 | Aoki et al. | 430/108 |
| 4,965,159 | 10/1990 | Kohno et al. | 428/407 X |

FOREIGN PATENT DOCUMENTS

| | | | |
|---|---|---|---|
| 0362858 | 4/1990 | European Pat. Off. | 430/108 |
| 223459 | 12/1984 | Japan | 430/108 |
| 120169 | 6/1986 | Japan | 430/108 |
| 120170 | 6/1986 | Japan | 430/108 |

*Primary Examiner*—Roland Martin

*Attorney, Agent, or Firm*—Larson and Taylor

[57] ABSTRACT

This invention provides a carrier for developing electrostatic images comprising a core and a coating on the core, the coating being formed from a copolymer comprising a fluoralkyl acrylate and a monomer copolymerizable therewith.

1 Claim, No Drawings

COATED CARRIERS FOR DEVELOPING ELECTROSTATIC IMAGES

FIELD OF THE INVENTION

The present invention relates to a carrier comprising a core and a coating on the core for developing electrostatic images, the carrier constituting, along with a toner, an electrostatic image developer for use with an electronic photographic copying machine (hereinafter referred to simply as "carrier").

BACKGROUND OF THE INVENTION

Known carriers include those coated with a homopolymer comprising fluorinated acrylate or fluorinated methacrylate (Japanese Unexamined Patent Publication No. 53-97,435). However, the polymer is brittle and forms a coating low in durability, adhesion to the core material, strength, etc.

Also known are carriers coated with a composition comprising a polymer having crosslinkable functional groups and a crosslinking agent (Japanese Unexamined Patent Publication No. 60-59,369). However, the composition tends to insufficiently crosslink depending on the crosslinking conditions, forming a coating of low durability. Functional groups in the polymer such as organic acid residues, hydroxyl, epoxy, imino, etc. are hydrophilic and result in lower or unstable electrostatic charge capacity under humid conditions.

SUMMARY OF THE INVENTION

It is the primary object of the present invention to provide a carrier comprising a core and a coating on the core, the coating being composed of a copolymer excellent in durability.

It is another object of the invention to provide a carrier comprising a core and a coating on the core, the coating having a good adhesion to the core and high strength.

It is a further object of the invention to provide a carrier comprising a core and a coating on the core, the coating having a great electrostatic charge capacity.

Other objects and features of the invention will become apparent from the following description.

We conducted extensive research to overcome the foregoing problems of the conventional techniques and found that specific homopolymers and copolymers exhibit outstanding properties when used for coating the carrier core.

According to the present invention, there is provided a carrier for developing electrostatic images, the carrier comprising a core and a coating on the core, the coating being formed from a copolymer or a composition containing the copolymer, the copolymer comprising about 50 to about 99% by weight of a monomer represented by the formula

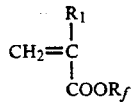

(a)

wherein $R_1$ is a hydrogen atom, a fluorine atom, a chlorine atom or a methyl group, and $R_f$ is a fluoroalkyl group, and about 50 to about 1% by weight of a monomer represented by the formula

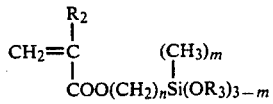

(b)

wherein $R_2$ is a hydrogen atom, a fluorine atom, a chlorine atom or a methyl group, $R_3$ is a methyl group, an ethyl group, a propyl group, a methoxyethyl group or an acetyl group, m is 0, 1 or 2 and n is an integer of 1 to 4 (hereinafter referred to as "invention I").

According to the invention, there is also provided a carrier for developing electrostatic images, the carrier comprising a core and a coating on the core, the coating being formed from a copolymer or a composition containing the copolymer, the copolymer comprising about 50 to about 99% by weight of a monomer represented by the formula

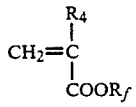

(c)

wherein $R_4$ is a hydrogen atom, a fluorine atom or a methyl group, and $R_f$ is a fluoroalkyl group, and about 50 to about 1% by weight of a monomer represented by the formula

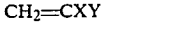

(d)

wherein X is a hydrogen atom or a chlorine atom, and Y is a chlorine atom (hereinafter referred to as "invention II").

According to the invention, there is further provided a carrier for developing electrostatic images, the carrier comprising a core and a coating on the core, the coating being formed from a copolymer or a composition containing the copolymer, the copolymer comprising about 99.9 to about 85% by weight of a monomer represented by the formula

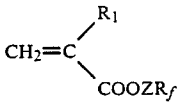

(e)

wherein $R_1$ is a hydrogen atom, a fluorine atom, a chlorine atom or a methyl group, Z is $(CH_2)_{m'}$ (wherein m' is 1 or

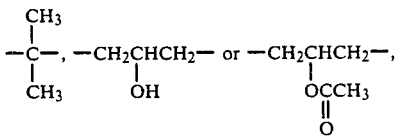

fluoroalkyl group, and about 0.1 to about 15% by weight of a monomer having an $\alpha,\beta$-unsaturated double bond and a carboxylic acid group or a carboxylic anhydride group at the side chain (hereinafter referred to as "invention III").

According to the invention, there is also provided a carrier for developing electrostatic images, the carrier comprising a core and a coating on the core, the coating being formed from a homopolymer or a composition containing the homopolymer, the homopolymer comprising a monomer represented by the formula

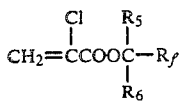

(f)

wherein $R_5$ and $R_6$ are the same or different and each represent a hydrogen atom, a methyl group, an ethyl group or a propyl group, and $R_f$ is an alkyl group containing 3 or more fluorine atoms (provided that one or more oxygen atoms may be contained in the molecule) (hereinafter referred to as "invention IV").

According to the invention, there is also provided a carrier for developing electrostatic images, the carrier comprising a core and a coating on the core, the coating being formed from a copolymer or a composition containing the copolymer, the copolymer comprising about 20 to about 99.9% by weight of a monomer represented by the formula

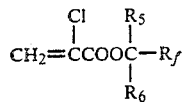

(f)

wherein $R_5$ and $R_6$ are the same or different and each represent a hydrogen atom, a methyl group, an ethyl group or a propyl group, and $R_f$ is an alkyl group containing 3 or more fluorine atoms (provided that one or more oxygen atoms may be contained in the molecule), and about 80 to about 0.1% by weight of a monomer copolymerizable with the monomer of the formula (f) but not being an acrylic or methacrylic acid (hereinafter referred to as "invention V").

According to the invention, there is also provided a carrier for developing electrostatic images, the carrier comprising a core and a coating on the core, the coating being formed from a polymer or a composition containing the polymer, the polymer comprising at least about 70% by weight of at least one monomer selected from a monomer represented by the formula

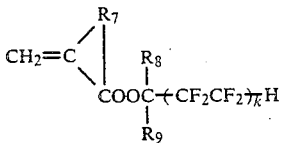

(g)

wherein $R_7$ is a hydrogen atom or a methyl group, $R_8$ and $R_9$ are the same or different or different and each represent a hydrogen atom, a methyl group, an ethyl group or a propyl group (provided that when $R_8$ is a hydrogen atom, $R_9$ can not be a hydrogen atom), and k is an integer of 1 to 5, a monomer represented by the formula

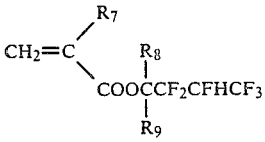

(h)

wherein $R_7$, $R_8$ and $R_9$ are as defined above, and a monomer represented by the formula

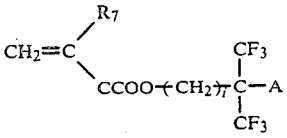

(i)

wherein $R_7$ is as defined above, A is a hydrogen atom, a methyl group, a trifluoromethyl group, a phenyl group or a cyclohexyl group, and 1 is 0 or 1 (provided that when A is a trifluoromethyl group, 1 is 0) (hereinafter referred to as "invention VI").

DETAILED DESCRIPTION OF THE INVENTION

The inventions I to VI will be described below in greater detail.

I. Invention I

The monomer (a), i.e. one of the monomers for use in the invention I, is represented by the formula

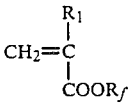

wherein $R_1$ is a hydrogen atom, a fluorine atom, a chlorine atom or a methyl group, and $R_f$ is a fluoroalkyl group having 1 to 20 carbon atoms. Examples of the monomer (a) are as follows.

$CH_2{=}CHCOOCH_2CF_3$ $CH_2{=}CFCOOCH_2CF_3$ $CH_2{=}C(CH_3)COOCH_2CF_3$ $CH_2{=}CHCOOCH_2CF_2CF_2H$ $CH_2{=}C(CH_3)COOCH_2CF_2CF_2H$ $CH_2{=}CHCOOCH_2CF_2CF_3$ $CH_2{=}CClCOOCH_2CF_2CF_3$ $CH_2{=}C(CH_3)COOCH_2CF_2CF_3$ $CH_2{=}CHCOOC(CH_3)_2CF_2CF_2H$ $CH_2{=}C(CH_3)COOC(CH_3)_2CF_2CF_2H$ $CH_2{=}CHCOOCH_2CF_2CFHCF_3$ $CH_2{=}C(CH_3)COOCH_2CF_2CFHCF_3$ $CH_2{=}CFCOOCH_2(CF_2CF_2)_2H$ $CH_2{=}C(CH_3)COOCH_2(CF_2CF_2)_2H$ $CH_2{=}CHCOOCH_2C(CF_3)_2H$ $CH_2{=}C(CH_3)COOCH_2C(CF_3)_2H$ $CH_2{=}CHCOOCH_2CH_2(CF_2)_7CF_3$ $CH_2{=}C(CH_3)COOCH_2CH_2(CF_2)_7{-}CF_3$ $CH_2{=}CHCOOCH_2CH_2(CF_2)_7CF{-}(CF_3)_2$ $CH_2{=}C(CH_3)COOCH_2CH_2(CF_2)_7{-}CF(CF_3)_3$ ti $CF_3OCF_2CF_2CH_2OCOCH{=}CH_2$ $CF_3OCF_2CF_2CH_2OCOC(CH_3){=}CH_2$ $CF_3CF_2OCF_2CF_2CH_2OCOCH{=}CH_2$ $CF_3CF_2OCF_2CF_2CH_2OCOC(CH_3){=}CH_2$ $CF_3(CF)_2OCF_2CF_2CH_2OCOCH{=}CH_2$ $CF_3(CF)_2OCF_2CF_2CH_2OCOC(CH_3){=}CH_2$ $CF_3(CF)_3OCF_2CF_2CH_2OCOCH{=}CH_2$ $CF_3(CF)_3OCF_2CF_2CH_2OCOC(CH_3){=}CH_2$

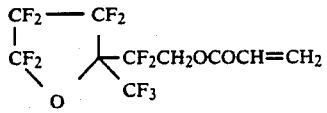

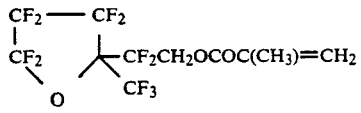

$CF_3CH_2OCH_2CH_2OCOCH{=}CH_2$ $CF_3CH_2OCH_2CH_2OCOC(CH_3){=}CH_2$ $CF_2HCF_2OCH_2CH_2OCOCH{=}CH_2$ $CF_2HCF_2OCH_2CH_2OCOC(CH_3){=}CH_2$ $CF_2HCF_2(OCH_2CH_2)_2OCOCH{=}CH_2$ $CF_2HCF_2(OCH_2CH_2)_2OCOC(CH_3){=}CH_2$ $CF_3CF_2CF_2CH_2OCH_2CH_2OCOCH{=}CH_2$ $CF_3CF_2CF_2CH_2OCH_2CH_2OCOC(CH_3){=}CH_2$

The monomer (b), i.e. the other monomer for use in the invention I, is represented by the formula

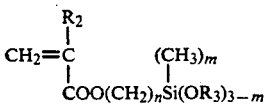

wherein $R_2$ is a hydrogen atom, a fluorine atom, a chlorine atom or a methyl group, $R_3$ is a methyl group, an ethyl group, a propyl group, a methoxyethyl group or an acetyl group, m is 0, 1 or 2, and n is an integer of 1 to 4. Examples of the monomer (b) are as follows.

$CH_2{=}CHCOOCH_2Si(OCH_3)_3$ $CH_2{=}C(CH_3)COOCH_2Si(OCH_3)_3$ $CH_2{=}CHCOOCH_2CH_2Si(OCH_3)_3$ $CH_2{=}C(CH_3)COOCH_2CH_2Si{-}(OCH_3)_3$ $CH_2{=}CHCOOCH_2CH_2CH_2Si{-}(OCH_3)_3$ $CH_2{=}C(CH_3)COOCH_2CH_2CH_2Si{-}(OCH_3)_3$ $CH_2{=}CFCOOCH_2CH_2CH_2Si{-}(OCH_3)_3$ $CH_2{=}CClCOOCH_2CH_2CH_2Si{-}(OCH_3)_3$ $CH_2{=}C(CH_3)COOCH_2CH_2CH_2Si{-}(OCH_2CH_3)_3$ $CH_2{=}C(CH_3)COOCH_2CH_2CH_2Si{-}(OCH_2CH_3)_3$ $CH_2{=}C(CH_3)COOCH_2CH_2CH_2Si{-}(CH_3)(OCH_3)_2$ $CH_2{=}CFCOOCH_2CH_2CH_2Si{-}(OCH_2CH_2OCH_3)_3$

The mixing ratio (weight ratio) of the monomer (a) to the monomer (b) in the copolymer useful for coating the carrier core in the invention I is 50–99:50–1, preferably 70–95:30–5. The molecular weight of the copolymer is expressed in an intrinsic viscosity ($\eta$) of about 0.05 to about 1.5 as determined at 35° C. using methyl ethyl ketone or m-xylene hexafluoride as a solvent. If the amount of the monomer (a) used is less than 50% by weight, the carrier is given an insufficient electrostatic charge capacity. On the other hand, if the amount of the monomer (a) used exceeds 99% by weight, the carrier is deteriorated in durability. Therefore the use of the monomer (a) in an amount outside said range is undesirable.

Usable as the catalyst for crosslinking the alkoxysilyl group of the monomer (b) are dibutyl laurate, di-n-butyltin dichloride, acetic acid, hydrochloric acid and the like.

Preferred examples of copolymers for use in the invention I are as follows.

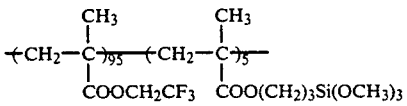

A-1

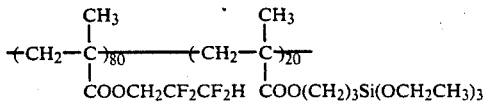

A-2

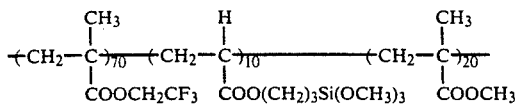

A-3

-continued

A-4

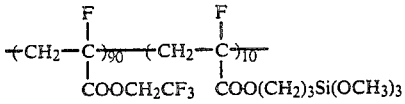

A-5

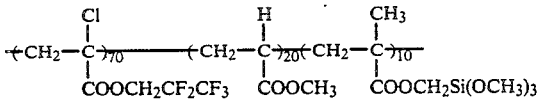

A-6

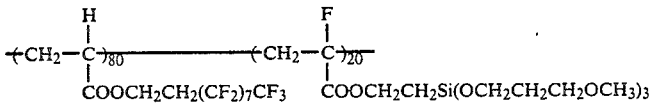

The carrier core can be coated by any of the conventional methods as disclosed in Japanese Unexamined Patent Publication Nos. 60-60,656, 61-120,169, etc. More specifically, the surface of the carrier core is coated by the desired conventional method with a solution of the copolymer in a solvent such as acetone, methyl ethyl ketone, methyl isobutyl ketone or like ketone solvents; ethyl acetate, methyl acetate, n-butyl acetate or like acetic acid ester solvents; or tetrahydrofuran, dioxane, dimethylformamide, diethylformamide or the like. A preferred solvent has a boiling point of about 80 to about 140° C. in view of, the evaporation rate and the like. After the formation of coating on the core, the carrier may be heated to a temperature up to about 150° C. to improve the properties of the coating.

The materials useful for the carrier core in the invention I are not specifically limited and can be any of conventional materials such as iron, cobalt, nickel and like metals; ferrite, magnetite, Mn-Cu-Al, Mn-Cu-Sn and like alloys; and $CrO_2$ and like metallic oxides. The carrier core is usually about 30 to about 1,000 μm, preferably about 50 to about 500 μm, in diameter.

The copolymer for covering the carrier core in the invention I may contain a copolymerizable monomer as a third component in addition to the foregoing monomer components in such an amount that the addition will not impair the properties of the copolymer, for example in an amount of up to about 50% by weight of the copolymer. Examples of such monomer are styrenes such as styrene, α-methylstyrene, chloromethylstyrene and the like; alkyl acrylates or methacrylates such as methyl acrylate, ethyl acrylate, propyl acrylate, butyl acrylate, amyl acrylate, hexyl acrylate, octyl acrylate, 2-chloroethyl acrylate, N,N-dimethylaminoethyl acrylate, methyl methacrylate, ethyl methacrylate, propyl methacrylate, butyl methacrylate, amyl methacrylate, hexyl methacrylate, octyl methacrylate, 2-chloroethyl methacrylate, N,N-dimethylaminoethyl methacrylate and the like; vinyl ethers such as ethyl vinyl ether, 2-chloroethyl vinyl ether, propyl vinyl ether, butyl vinyl ether, octyl vinyl ether, phenyl vinyl ether and the like; vinyl esters such as vinyl acetate, vinyl chloroacetate, vinyl butyrate, vinyl benzoate and the like; vinylketones such as methyl vinylketone, ethyl vinylketone, propyl vinylketone, butyl vinylketone, phenyl vinylketone and the like; olefins such as ethylene, propylene, isobutene, butadiene, isoprene and the like; and nitrogen-containing compounds such as N-vinylpyrrolidone, N-vinylcarbazole, 4-vinylpyridine and the like; vinylnitriles such as acrylonitrile, methacrylonitrile and the like.

The thickness of a coating layer to be formed on the carrier core in the invention I can be varied as desired, but is usually about 0.5 to about 50 μm, preferably about 1 to about 5 μm.

II. Invention II

The monomer (c), i.e. one of the monomers for use in the invention II, is represented by the formula

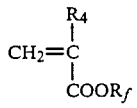

wherein $R_4$ is a hydrogen atom, a fluorine atom or a methyl group, and $R_f$ is a fluoroalkyl group. Examples of the monomer (c) are as follows.

$CH_2{=}CHCOOCH_2CF_3$ $CH_2{=}CFCOOCH_2CF_3$ $CH_2{=}C(CH3)COOCH_2CF_3$ $CH_2{=}CHCOOCH_2CF_2CF_2H$ $CH_2{=}C(CH3)COOCH_2CF_2CF_3$

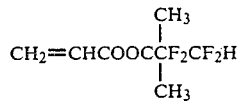

$CH_2{=}CFCOOCH_2CH_2C_8F_{17}$ $CH_2{=}C(CH_3)COOCH_2C(CF_2CF2)_2H$

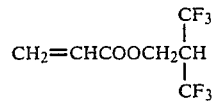

The monomer (d), i.e. the other monomer for use in the invention II, is represented by the formula $CH_2{=}CXY$ wherein X is a hydrogen atom or a chlorine atom, and Y is a chlorine atom. Examples of the monomer (d) are vinyl chloride, vinylidene chloride, etc.

The mixing ratio (weight ratio) of the monomer (c) to the monomer (d) in the copolymer for the carrier core in the invention II is 50–99:50–1, preferably 70–95:30–5.

The molecular weight of the copolymer is expressed in an intrinsic viscosity ($\eta$) of about 0.1 to about 1.5 as determined at 35° C. using methyl ethyl ketone or m-xylene hexafluoride as a solvent. If the amount of the monomer (c) used is less than 50% by weight, the carrier is given a low electrostatic charge capacity and is impaired in other properties. On the other hand, if the amount of the monomer (c) used exceeds 99% by weight, the coating is deteriorated in adhesion to the core and the carrier becomes poor in durability. Therefore the use of the monomer (c) in an amount outside said range is undesirable.

The copolymer for use in the invention II may further contain a copolymerizable monomer as a third component in such an amount that the addition will not impair the properties of the copolymer, for example in an amount of up to about 30% by weight of the copolymer. Examples of such monomer are acrylic or methacrylic acid, methyl acrylate or methacrylate, ethyl acrylate or methacrylate, butyl acrylate or methacrylate, benzyl acrylate or methacrylate, amide acrylate or methacrylate, cyclohexyl acrylate or methacrylate, glycidyl acrylate or methacrylate, hydroxyethyl acrylate or methacrylate, styrene, vinyl acetate, ethylene, propylene, isoprene, etc.

Preferred examples of copolymers for use in the invention II are given below.

B-1

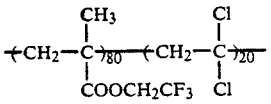

B-2

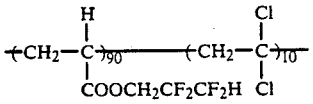

B-3

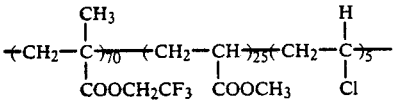

B-4

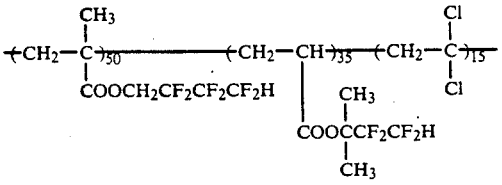

B-5

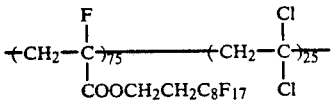

A coating can be formed on the carrier core in the invention II by any of conventional methods as in the invention I.

The carrier core for use in the invention II may be the same as in the invention I.

The thickness of the coating in the invention II may be in the same range as in the invention I.

III. Invention III

The monomer (e), i.e. one of the monomers for use in the invention III, is represented by the formula

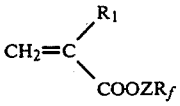

wherein $R_1$ is a hydrogen atom, a fluorine atom, a chlorine atom or a methyl group, Z is $(CH_2)_{m'}$ (wherein m' is 1 or 2),

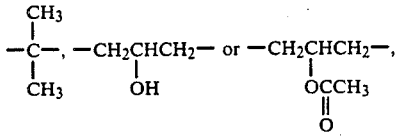

and Rf is a fluoroalkyl group having 1 to 20 carbon atoms.

Examples of the monomer of the formula (e) for use in the invention III are as follows.

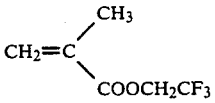

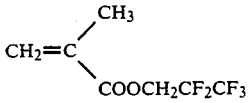

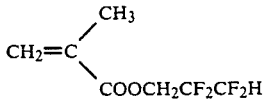

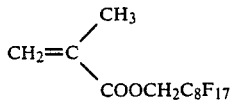

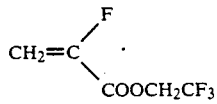

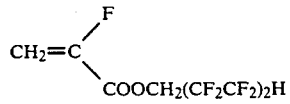

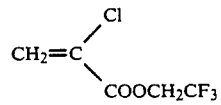

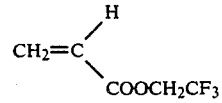

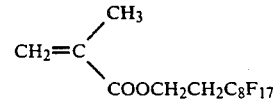

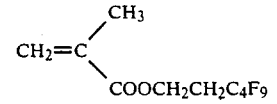

-continued

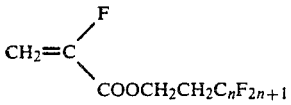

(n = 8, 10, 11 and 12)

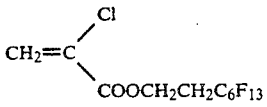

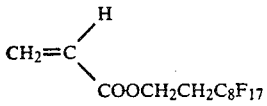

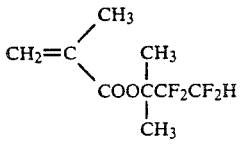

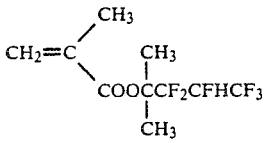

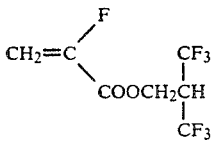

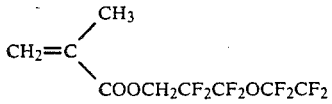

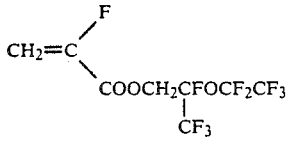

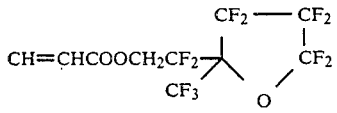

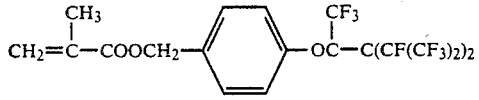

The monomers exemplified above as the monomer (e) are usable singly or at least two of them can be used in mixture.

Usable as the monomer having an $\alpha,\beta$-unsaturated double bond and a carboxylic acid group or carboxylic anhydride group at the side chain in the invention III are, for example, acrylic acid, methacrylic acid, itaconic acid, maleic anhydride, fumaric acid, maleic acid, $\alpha$-fluoroacrylic acid, $\alpha$-chloroacrylic acid, etc. These monomers are usable singly or at least two of them can be used in mixture.

The proportions of the monomer (e) and the $\alpha,\beta$-unsaturated monomer for the copolymer in the invention III are about 99.9 to about 85% by weight of the former and about 0.1 to about 15% by weight of the latter, preferably about 99.5 to about 90% by weight of the former and about 0.5 to about 10% by weight of the latter, more preferably about 99 to about 95% by weight of the former and about 1 to about 5% by weight of the latter. If the amount of the latter used is less than 0.1% by weight, the copolymer is given only an insufficiently improved adhesion to the core. On the other hand, if the amount of the latter used exceeds 15% by weight, the carrier becomes hydrophilic in the surface, resulting in impaired electrostatic charge capacity.

Optionally the copolymer for use in the invention III may further contain a copolymerizable monomer as a third component in an amount of up to about 30% by weight based on the combined weight of the monomer (e) and the $\alpha$, $\beta$-unsaturated monomer in order to improve the glass transition temperature (Tg) of the copolymer, the solvent solubility thereof and the electrostatic charge capacity of the carrier and the like. Examples of such monomer are styrenes such as styrene, $\alpha$-methylstyrene, chloromethyl-styrene and the like; alkyl acrylates or methacrylates such as methyl acrylate, ethyl acrylate, propyl acrylate, butyl acrylate, amyl acrylate, hexyl acrylate, octyl acrylate, 2-chloroethyl acrylate, methyl $\alpha$-fluoroacrylate, ethyl $\alpha$-fluoroacrylate, methyl $\alpha$-chloroacrylate, methyl methacrylate, ethyl methacrylate, propyl methacrylate, butyl methacrylate, amyl methacrylate, hexyl methacrylate, octyl methacrylate, 2-chloroethyl methacrylate and the like; vinyl ethers such as ethyl vinyl ether, 2-chloroethyl vinyl ether, propyl vinyl ether, butyl vinyl ether, octyl vinyl ether, phenyl vinyl ether and the like; vinyl esters such as vinyl acetate, vinyl chloroacetate, vinyl butyrate, vinyl benzoate and the like; vinylketones such as methyl vinylketone, ethyl vinylketone, propyl vinylketone, butyl vinylketone, phenyl vinylketone and the like; olefins such as ethylene, propylene, isobutylene, butadiene, isoprene and the like; nitrogen-containing compounds such as N-vinylpyrrolidone, N-vinylcarbazole, 4-vinylpyridine, acrylonitrile, methacrylonitrile and the like; and haloolefins such as vinyl fluoride, vinylidene fluoride, ethylene trifluoride, ethylene tetrafluoride, vinyl chloride, vinylidene chloride and the like.

The molecular weight of the copolymer for use in the invention III is about 5,000 to about 5,000,000, preferably about 10,000 to about 1,000,000 as determined by gel permeation chromatography (calculated as polystyrene).

The copolymer for use in the invention III can be prepared by usual radical polymerization method such as bulk polymerization, suspension polymerization, emulsion polymerization or solution polymerization method.

Optionally a composition comprising the foregoing copolymer, a resin and/or additives is usable in the invention III as a coating material for coating the carrier core. Examples of useful resins are fluorine resins such as vinylidene fluoride, vinylidene fluoride-ethylene tetrafluoride copolymer or the like, or silicone resin, acrylic resin or the like. Examples of useful additives are silica flour, charge controlling agents, surfactants, lubricants and the like. A preferred amount of these materials used is up to about 50% by weight of the copolymer.

The same coating method for coating the carrier core and the same thicknesses of the carrier core and the coating as in the invention I may be adopted in the invention III.

A wide range of organic solvents are useful in the invention III unlike the case of conventionally using fluorine resins. Specific examples of organic solvents are ketone solvents such as acetone, methyl ethyl ketone, methyl propyl ketone, methyl isopropyl ketone, methyl isobutyl ketone and the like; acetate solvents such as ethyl acetate, cellosolve acetate, n-butyl acetate and the like; cyclic ethers such as tetrahydrofuran, dioxane and the like; aromatic hydrocarbons such as toluene, xylene and the like; halogenated hydrocarbons such as tetrachloroethylene, trichloroethylene, methylene chloride and the like; alcohols such as methyl alcohol, ethyl alcohol, butyl alcohol, isopropyl alcohol and the like; and fluorine-containing solvents such as 1,1,2-trifluorotrichloroethane, 1,2-difluorotetrachloroethane, hexafluorometaxylene, 1,1,2,3,4-hexafluorotetrachlorobutane and the like. These solvents are usable singly or at least two of them can be used in mixture. Preferred solvents have a boiling point of about 60 to about 140° C. in view of the evaporation rate and the like.

IV. Invention IV

The monomer (f) for use in the invention IV is represented by the formula

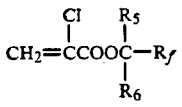

wherein $R_5$ and $R_6$ are the same or different and each represent a hydrogen atom, a methyl group, an ethyl group or a propyl group, and $R_f$ is an alkyl group containing 3 or more fluorine atoms (provided that one or more oxygen atoms may be present in the molecule).

Examples of the monomer (f) for use in the invention IV are as follows.

$CH_2{=}CClCOOCH_2CF_3$ $CH_2{=}CClCOOCH_2CF_2CF_3$ $CH_2{=}CClCOOCH_2CF_2CF_2H$ $CH_2{=}CClCOOCH_2(CF_2CF_2)_2H$ $CH_2{=}CClCOOCH_2CH_2(CF_2)_7CF_3$ $CH_2{=}CClCOOCH_2CF_2CFHCF_3$ $CH_2{=}CClCOOCH_2CH(CF_3)_2$ $CH_2{=}CClCOOCH_2CF_2CFHCF_3$ $CH_2{=}CClCOOCH_2CH(CF_3)_2$

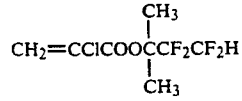

-continued

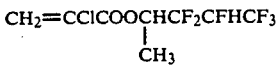

$CH_2{=}CClCOOCH_2CH_2(CF_2)_6CF(CF_3)_3$

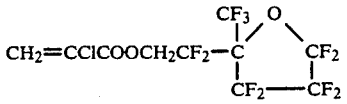

The monomers exemplified above as the monomer (f) are usable singly or at least two of them can be used in mixture.

V. Invention V

The copolymer comprising the monomer (f) and the other copolymerizable monomer are used int he invention V. Examples of the copolymerizable monomer are styrenes such as styrene, α-styrene and the like; esters of acrylic acids such as methyl acrylate, ethyl acrylate, propyl acrylate, cyclohexyl acrylate, benzyl acrylate, tricyclodecyl acrylate, stearyl acrylate, hydroxyethyl acrylate and the like; esters of methacrylic acids such as methyl methacrylate, ethyl methacrylate, butyl methacrylate, glycidyl methacrylate, trimethoxysilylpropyl methacrylate and the like; esters of α-halogenoacrylic acids such as methyl α-fluoroacrylate, ethyl α-fluoroacrylate, methyl α-chloroacrylate, ethyl α-chloroacrylate and the like; vinylpyridine, vinyl butyrate, vinyl acetate, N-vinylpyrrolidone, acrylamide, methacrylamide, acrylonitrile, methacrylonitrile, vinyl chloride, vinylidene chloride, propylene, ethylene and the like. Fluoroalkyl acrylate and fluoroalkyl methacrylate can be used in an amount not impairing the properties of the copolymer.

The proportion of the monomer (f) in the copolymer of the invention V is about 20 to about 99.9% by weight, preferably about 50 to about 99% by weight, and, in view of high solubility of the copolymer in a solvent, good film-forming property thereof and improved properties of the carrier, about 70% by weight or more, preferably about 70 to about 95% by weight.

The monomers are polymerized in the invention V by conventional methods for polymerizing fluorine-containing monomers such as mass polymerization, solution polymerization, suspension polymerization or emulsion polymerization method.

The inherent viscosity (η) of the polymer in the inventions IV and V is about 0.2 to about 2.0 as determined at 35° C. using a ketone, ester or fluorohydrocarbon as a solvent.

Optionally a monomer having a functional group may be incorporated into the polymer in the inventions IV and V to utilize the monomer in crosslinking.

Optionally, a composition comprising the foregoing polymer and a fluoroalkyl acrylate or methacrylate polymer may be used in the inventions IV and V (Japanese Unexamined Patent Publication No. 53-97,435). In this case, the polymer containing the monomer (f) is used in an amount of at least about 50% by weight, preferably at least about 70% by weight, of the composition in order to give the carrier a high durability and a stable electrostatic charge capacity due to friction. The polymer may contain conventional additives for carriers such as natural or synthetic resins (e.g. PMMA), dyes, pigments, plasticizers, silica flour, surfactants and the like. A preferred amount of the additive used is up to 30% by weight of the composition.

The same method for coating the carrier core and the same thicknesses of the carrier core and the coating as in the invention I may be adopted in the invention IV and V.

The solvents exemplified in the invention III can be used in coating the carrier core in the inventions IV and V.

VI. Invention VI

The polymer for use in the invention VI is composed of at least one monomer selected from a monomer represented by the formula

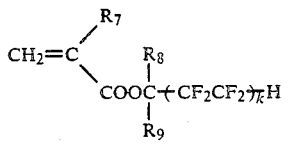

(g)

wherein $R_7$ is a hydrogen atom or a methyl group, $R_8$ and $R_9$ are the same or different and each represent a hydrogen atom, a methyl group, an ethyl group or a propyl group (provided that when $R_8$ is a hydrogen atom, $R_9$ can not be a hydrogen atom), and k is an integer of 1 to 5, a monomer represented by the formula

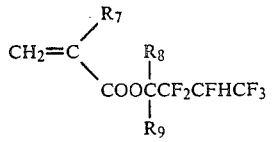

(h)

wherein $R_7$, $R_8$ and $R_9$ are as defined above, and a monomer represented by the formula

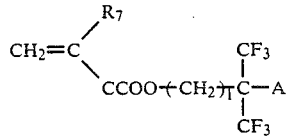

(i)

wherein $R_7$ is as defined above, A is a hydrogen atom, a methyl group, a trifluoromethyl group, a phenyl group or a cyclohexyl group, and 1 is 0 or 1 (provided that when A is a trifluoromethyl group, 1 is 0).

Examples of the monomer (g) are as follows.

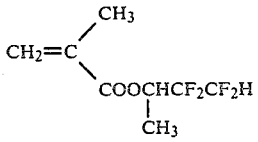

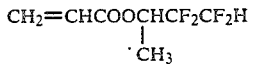

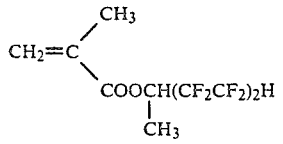

-continued

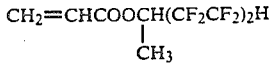

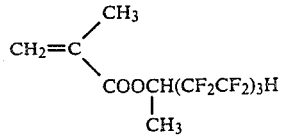

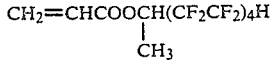

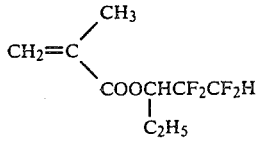

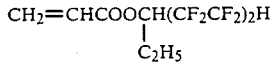

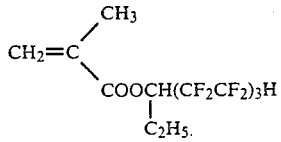

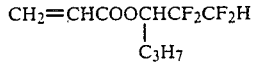

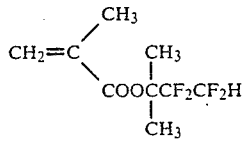

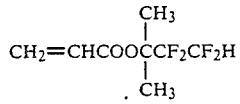

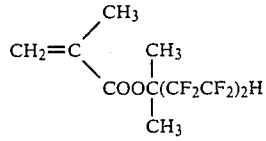

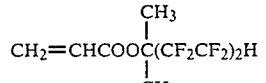

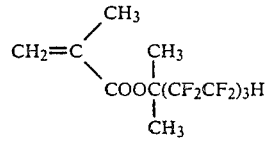

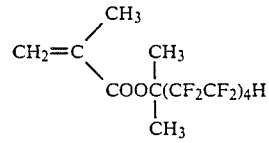

Examples of the monomer (h) are as follows.

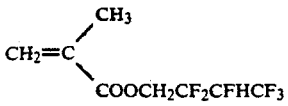

$CH_2{=}CHCOOCH_2CF_2CFHCF_3$

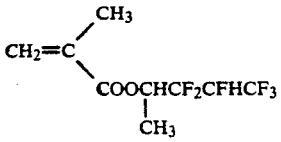

$CH_2{=}CHCOOCHCF_2CFHCF_3$ (CH3)

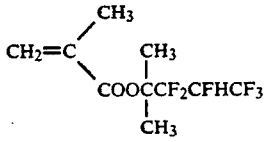

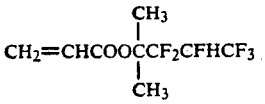

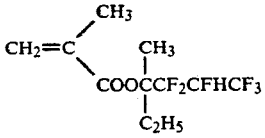

Examples of the monomer (i) are as follows.

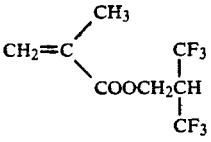

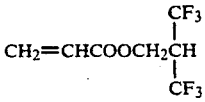

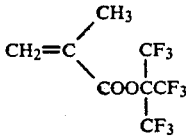

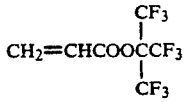

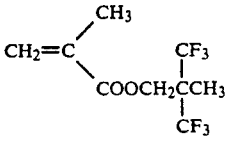

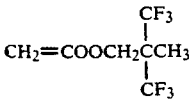

-continued

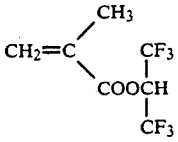

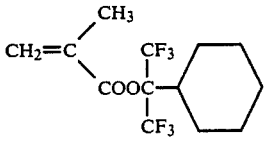

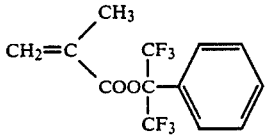

Among the monomers exemplified above for use in the invention VI, preferable are monomer units in which 8 or less fluorine atoms are present; $R_8$ and $R_9$ in the monomers (g) and (h) are a hydrogen atom or a methyl group; and A in the monomer (i) is a hydrogen atom, a cyclohexyl group or a phenyl group.

These monomers may be used singly to provide a homopolymer or in mixture to provide a copolymer.

At least one of the monomers (g), (h) and (i) is used in an amount of about 70% by weight or more, and one or more monomers copolymerizable therewith may be added in the invention (VI). Less than 70% by weight of the monomer(s) used reduces the content of fluorine atoms and thus decreases the electrostatic charge capacity, rendering the carrier unsatisfactory in properties.

One or more copolymerizable monomers can be added to the monomers (g) to (i) in an amount of up to about 30% in order to improve the glass transition temperature (Tg) of the copolymer, its solvent solubility and the electrostatic charge capacity of the core. There is no specific restriction on the kind of the copolymerizable monomer to be added. Examples of such monomer are styrenes such as styrene, α-methylstyrene, o-methylstyrene, p-methylstyrene, p-chloromethylstyrene, chlorostyrene and the like; esters of acrylic acids such as methyl acrylate, ethyl acrylate, propyl acrylate, butyl acrylate, 2-ethylhexyl acrylate, cyclohexyl acrylate and the like; esters of methacrylic acids such as methyl methacrylate, ethyl methacrylate, propyl methacrylate, butyl methacrylate, cyclohexyl methacrylate and the like; olefins or haloolefins such as ethylene, propylene, vinyl chloride, vinylidene chloride, vinyl acetate, vinyl pivalate, vinyl benzoate and the like; and nitrogen-containing compounds such as acrylamide, methacrylamide, acrylonitrile, vinylpyridine, methacrylonitrile and the like.

Further, one or more copolymerizable monomers containing functional groups may be added to the foregoing monomers. Examples of such monomers are hydroxyethyl methacrylate, hydroxypropyl methacrylate, glycidyl methacrylate, hydroxyethyl acrylate, hydroxypropyl acrylate, glycidyl acrylate, N-methylolmethacrylamide, N-methylolacrylamide, etc. In this case, a curing agent may be mixed with the copolymer. Then the mixture is applied to the carrier core and is cured. Examples of useful curing agents are toluylene diisocyanate, isophorone diisocyanate and like isocyanates, block isocyanates, melamines, acid anhydrides, diamines, etc.

The coating on the carrier core in the invention VI has preferably a glass transition temperature (Tg) of 50° C. or higher. A glass transition temperature of below 50° C. tends to render the coating soft and sticky during the color development, making the toner almost inseparable.

The polymer of the invention VI has an inherent viscosity of about 0.20 to about 2.0 as determined at 35° C. using methyl ethyl ketone, methyl isobutyl ketone or m-xylene hexafluoride as a solvent.

The polymer of the invention VI can be produced by usual radical polymerization methods such as bulk polymerization, suspension polymerization, emulsion polymerization or solution polymerization method.

The carrier core may be coated with a composition comprising the polymer, a resin and additives. Examples of useful resins are vinylidene fluoride, vinylidene fluoride-ethylene tetrafluoride copolymer and like fluorine resins, silicone resin, acrylic resin and like resins, etc. Useful additives are silica flour, charge controlling agents, surfactants, lubricants, etc. The amount of these materials used is preferably 50% by weight or less of the polymer.

The same method for coating the carrier core and the same thicknesses of the carrier core and the coating as in the invention I can be adopted in the invention VI.

The solvents useful in the invention III can be used in coating the carrier core in the invention VI.

The carriers of the inventions I to VI are used in combination with a conventional toner to develop electrostatic images. Such toner is prepared by dispersing a coloring agent in a binder resin. Useful binder resins are homopolymers, copolymers or mixtures thereof, each polymer being composed of a monomer or monomers selected from the group consisting of styrenes such as styrene, p-chlorostyrene, α-methylstyrene and the such as methyl acrylate, ethyl acrylate, n-propyl like; α-methylene fatty acid monocarboxylic acid esters acrylate, butyl acrylate, lauryl acrylate, 2-ethylhexyl acrylate, methyl methacrylate, ethyl methacrylate, n-butyl methacrylate, lauryl methacrylate, 2-ethylhexyl methacrylate and the like; vinylnitriles such as acrylonitrile, methacrylonitrile and the like; vinylpyridines such as 2-vinylpyridine, 4-vinylpyridine and the like; vinyl ethers such as methyl vinyl ether, isobutyl vinyl ether and the like; vinylketones such as methyl vinylketone, ethyl vinylketone, methyl isopropenylketone and the like; unsaturated hydrocarbons and halides thereof such as ethylene, propylene, isoprene, butadiene and the like; and chloroprene and like halogen-type unsaturated hydrocarbons. Also usable as the binder resins are rosin-modified phenolformalin resin, oil-modified epoxy resin, polyester resin, polyurethane resin, polyimide resin, cellulose resin, polyether resin and like non-vinyl resins, mixtures of the non-vinyl resin and the above vinyl resin, etc.

Examples of coloring agents for a toner are carbon black, Nigrosine, Aniline Blue, Calcoil Blue, Chrome Yellow, Ultramarine Blue, Methylene Blue, Rose Bengale, Phthalocyanine Blue, etc.

The toner may contain wax, silica, zinc stearate and like additives, when so desired.

The toner is mixed with the carrier usually in a ratio of about 0.3 to about 20 parts by weight of the former per 100 parts by weight of the latter, and the mixture is used as a developer for forming electrostatic images by magnetic brushing process, cascade process or the like.

Since the polymers for use in the present invention are dissolved well in a wide range of solvents, a composition can be easily formed. The coating film formed on the carrier core from the polymer or the composition containing the polymer according to the invention has such high strength and good adhesion to the carrier core that it not only exhibits a high rub resistance, excellent durability and the like, but gives a great electrostatic charge capacity to the carrier.

EXAMPLES

Given below are examples and comparison examples to clarify the features of the present invention in greater detail.

EXAMPLES 1 TO 9

A 2 parts by weight quantity of the copolymer as indicated in A-1 above and 1 part by weight of a 0.001% solution of dibutyltin dilaurate serving as a catalyst in isopropanol were dissolved in a solvent of a mixture of acetone/methyl ethyl ketone to prepare a coating solution. A 100 parts by weight quantity of spherical iron particles (trademark "DSP 135C", product of Dowa Iron Powder Co., Ltd.) serving as the carrier core material was coated with the solution by the conventional method using a fluidized bed apparatus at a temperature of 30° C. in the bath for 20 minutes, heat-treated at 120° C. for 5 minutes and cooled to room temperature to give a product in the form of an agglomerate. The product was sieved to obtain a carrier of Example 1 having a coating layer of 2 μm thickness over the core.

Among the conditions for preparation of carriers employed in Examples 2 to 9, the conditions different from those in Example 1 are given below.

Example 2:
Temperature in the bath; 25° C.
Heat treatment; not conducted
Example 3:
Heat treatment; at 80° C. for 10 minutes
Example 4:
Copolymer; A-2 as indicated above (Molecular weight:
intrinsic viscosity $[\eta]=0.28$)
Example 5:
Copolymer; A-2 as indicated above (Molecular weight:
intrinsic viscosity $[\eta]=0.28$)
Heat treatment; at 150° C. for 2 minutes
Example 6:
Copolymer; A-3 as indicated above (Molecular weight:
intrinsic viscosity $[\eta]=0.53$)
Example 7:
Copolymer; A-4 as indicated above (Molecular weight:
intrinsic viscosity $[\eta]=0.68$)
Example 8:
Copolymer; A-5 as ,indicated above (Molecular weight:
intrinsic viscosity $[\eta]=0.18$)
Example 9:
Copolymer; A-6 as indicated above (Molecular weight:
intrinsic viscosity $[\eta]=0.51$)
Solvent; m-xylenehexafluoride

COMPARISON EXAMPLE 1

A 2 parts by weight quantity of the copolymer represented by the following formula (a) (molecular weight: intrinsic viscosity $[\eta]=0.38$) and 0.5 part by weight of a crosslinking agent represented by the formula (b) below were dissolved in a solvent of a mixture of acetone/-methyl ethyl ketone to obtain a coating solution. A 100 parts by weight quantity of spherical iron particles (trademark "DSP 135C", product of Dowa Iron Powder Co., Ltd.) serving as the carrier core material was coated with the solution by a known procedure with use of a fluidized bed apparatus at a temperature of 50° C. in the bath for 20 minutes, was heated to 120° C. at a rate of temperature elevation of 20° C./min for heat treatment for 5 minutes and cooled to room temperature to give a product in the form of an agglomerate. The product obtained was sieved, giving a carrier having a coating layer of 2 μm thickness over the core.

(a)

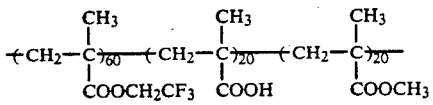

(b)

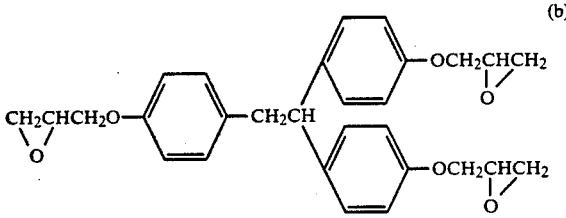

COMPARISON EXAMPLE 2

The same procedure as in Comparison Example 1 was repeated with the exception of using a copolymer represented by the following formula (c) (molecular weight: intrinsic viscosity $[\eta]=0.38$), giving a carrier.

(c)

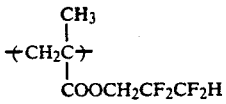

TEST EXAMPLE 1

Each carrier obtained in Examples 1 to 9 and Comparison Examples 1 and 2 was stirred by a ball mill for 100 hours, washed with a solvent of a 1:1 acetone/MEK mixture. Then the degree of peel resistance was evaluated by comparing the amounts of the coating dissolved out before and after the stirring.

Table 1 shows the results.

The evaluation of peel resistance was represented according to the following ratings:

A . . . No peeling

B . . . Peeling occurred over less than 5% of coating portion

C . . . Peeling occurred over 5 to 10% of coating portion

D . . . Peeling occurred over 10% or more of coating portion

TABLE 1

| | Degree of peel resistance |
|---|---|
| Example | |
| 1 | A |
| 2 | A |
| 3 | A |
| 4 | A |
| 5 | A |
| 6 | A |
| 7 | A |
| 8 | A |
| 9 | A |
| Comp. Example | |
| 1 | C |
| 2 | D |

Table 1 shows that the carriers of the present invention had coatings of high strength with excellent adhesion.

TEST EXAMPLE 2

A cluster of toner particles 9 μm in mean particle size was prepared by mixing together with use of a ball mill 100 parts by weight of a styrene/methyl methacrylate/n-butyl methacrylate copolymer (=50/20/30), 10 parts by weight of carbon black (trademark "Regal 660R," product of Cabot Co., Ltd.) and 3.5 parts by weight of a low-molecular-weight polypropylene (trademark "Viscol 660P," product of Sanyo Chemical Industry, Ltd.), kneading and grinding the mixture and classifying the particles. Two parts by weight of the toner was mixed with 100 parts by weight of each carrier obtained in Examples 1 to 9 and Comparison Examples 1 and 2, giving developers for electronic photographic copying machines.

Using the developers thus prepared, a copying operation was continuously carried out to produce photocopies on the modified version of electrophotographic copying machine "U-Bix 3000" (trademark, product of Konishiroku Photo Industry Co., Ltd.) incorporating a negative electrostatic dual-layer organic photoconductive photosensitive member containing an anthoanthrone-type pigment as a charge-generation material and a carbazole derivative as a charge-transported material. Up to 50,000 photocopies can be continuously produced on which images with no fogging were formed using the developers containing the carriers of Examples 1 to 8. When using the developer with the carrier of Example 9, up to 45,000 photocopies can be continuously produced on which images with no fogging were formed.

On the other hand, the copying operation using the developer with the carrier of Comparison Example 1 initiated fogging on production of 30,000 photocopies, and the copying operation using the developer with the carrier of Comparison Example 2 induced fogging on production of 20,000 photocopies.

EXAMPLES 10 TO 13

A 15 g quantity of each of the copolymers indicated above in B-1 to B-4 was dissolved in 500 ml of a solvent of a mixture of acetone/methyl ethyl ketone/-chloroform (=1/1/1) to produce coating solution. One kilogram of spherical iron particles (trademark "DSP 135C", product of Dowa Iron Powder Co., Ltd.) was coated with each solution by the conventional method using a fluidized bed apparatus, affording four kinds of carriers having a 2 μm-thick coating layer.

EXAMPLE 14

A carrier having a coating layer of 2 μm thickness was obtained in the same manner as in Example 10 with the exception of using a coating solution prepared by dissolving 15 g quantity of the copolymer shown in B-5 in 500 ml of 1,1,2-trichloro-1,2,2-trifluoroethane.

COMPARISON EXAMPLES 3 AND 4

Two kinds of comparative carriers each having a 2 μm-thick coating layer were produced by the same procedure as in Example 10 with the exception of using a polymer represented by the following formula (c) (molecular weight: intrinsic viscosity $[\eta]=0.62$) and a copolymer of the formula (d) below (molecular weight: intrinsic viscosity $[\eta]=0.48$).

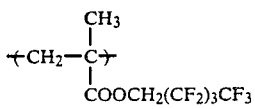

(c)

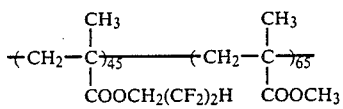

(d)

TEST EXAMPLE 3

Each carrier obtained in Examples 10 to 14 and Comparison Examples 3 and 4 was stirred by a ball mill for 100 hours, and the degree of peel resistance was evaluated by comparing the amounts of the coating dissolved out before and after the stirring.

Table 2 shows the results.

The evaluation of peel resistance was represented according to the following ratings:

A . . . No peeling

B . . . Peeling occurred over less than 5% of coating portion

C . . . Peeling occurred over 5 to 10% of coating portion

D . . . Peeling occurred over 10% or more of coating portion

TABLE 2

| | Degree of peel resistance |
|---|---|
| Example | |
| 10 | A |
| 11 | A |
| 12 | A |
| 13 | A |
| 14 | A |
| Comp. Example | |
| 3 | D |
| 4 | C |

Table 2 shows that the carriers according to the invention had coatings of high strength with excellent adhesion.

TEST EXAMPLE 4

Preparation of toner A

Into a round flask equipped with a thermometer, a stirrer, a tube for nitrogen gas introduction and a condenser of Liebig type were placed 332 g of terephthalic acid, 90 g of polyoxypropylene(2,2)-2,2-bis(4-hydroxyphenyl)propane and 587 g of bisphenol A. The flask was installed in mantle heater and heated in an atmosphere of nitrogen gas. A 0.05 g quantity of dibutyltin oxide was added thereto and the resulting mixture was subjected to reaction at 300° C. while checking the variation of the softening point, giving a polyester.

Toner A having a mean particle size of 10 μm was produced by mixing together with use of a ball mill 100 parts by weight of the polyester obtained above, 10 parts by weight of carbon black (trademark "Regal 660R", product of Cabot Co., Ltd., U.S.A.), 2 parts by weight of a low-molecular-weight polypropylene (trademark "Viscol 660P", product of Sanyo Chemical Industry, Ltd.) and 2 parts by weight of ethylenebis-stearoyl amide (trademark "Hextwax G", product of Hext Co., Ltd.), kneading and grinding the mixture and classifying the particles.

PREPARATION OF TONER B

A 100 parts by weight of a copolymer consisting of styrene/methyl methacrylate/n-butyl methacrylate (molar ratio=50/20/30), 10 parts by weight of carbon black (trademark "Regal 660R", product of Cabot Co., Ltd.) and 3 parts by weight of a low-molecular-weight polypropylene (trademark "Viscol 660P", product of Sanyo Chemical Industry, Ltd.) were mixed together by a ball mill, kneading and grinding the resulting mixture and classifying the particles to produce toner B having a mean particle size of 11 μm.

PREPARATION OF DEVELOPERS

Seven kinds of developers for electronic photographic copying machines were prepared by mixing together 2 parts by weight of the toner A or the toner B with 100 parts by weight of each of the carriers obtained in Examples 10 to 14 and Comparison Examples 3 and 4.

Using each of the developers thus prepared, a copying operation was continuously carried out in the same manner as in Test Example 2 with the results shown below in Table 3.

In Table 3, each Roman numerals used has the following means.

I. . . The quantity of electrostatic charge (μc/g) initially imparted to the developer and measured by a known blowoff method.

II . . . Relative density of the images given upon development in the case where the density of the images of the original pictures is taken as 1.0.

III . . . The number of the photocopies produced until the quality of the images begins to deteriorate with the occurrence of the fogging. The mark "X" is intended to denote that the fogging occurred from the first.

TABLE 3

| Carrier | Toner | I | II | III |
|---|---|---|---|---|
| Example 10 | A | +28.5 | 1.2 | >20000 |
| Example 11 | B | +29.9 | 1.2 | >20000 |
| Example 12 | B | +26.2 | 1.2 | >20000 |
| Example 13 | B | +27.7 | 1.3 | >20000 |
| Example 14 | B | +18.5 | 1.4 | >20000 |
| Comp. Ex. 3 | A | +20.4 | 1.4 | 16000 |
| Comp. Ex. 4 | B | +7.5 | 1.4 | X |

Table 3 shows that the carriers of the present invention can impart to the toner an appropriate quantity of electrostatic charge, enhance the degree of the maximum density of the images and are outstanding in durability.

In comparison therewith, the carriers of Comparison Examples 3 and 4 were satisfactory in the quantity of the electrostatic charge and the density of the images in the initial stage of photocopying, but poor in durability.

EXAMPLES 15 TO 18 AND COMPARISON EXAMPLES 5 AND 6

Each of the copolymer prepared from the monomers as shown in Table 4 in the listed amounts was dissolved in a solvent of a 1:1 acetone/methyl ethyl ketone mixture, giving a coating solution (concentration: 1%).

Subsequently, a cluster of spherical iron particles (trademark "DSP 135C", product of Dowa Iron Powder Co., Ltd.) was coated with the coating solution obtained above to a thickness of 2 μm on dry basis, producing the carriers according to the invention and those of Comparison Examples.

On the other hand, a cluster of toner particles having a mean particle size of 10 μm was prepared by mixing together 100 parts by weight of styrene-type resin (trademark "Bicorustic D125", product of Esso Standard Oil Co., Ltd.), 5 parts by weight of a low-molecular-weight polypropylene (trademark "Viscol 660R", product of Sanyo Chemical Industry, Ltd.) and 5 parts by weight of a pigment (trademark "Oil black BW", product of Orient Chemical, Co., Ltd.), kneading and grinding the mixture and classifying the particles.

A developer was prepared by admixing 100 parts by weight of the carrier obtained above and 10 parts by weight of the toner particles.

The developer obtained was stirred for 200 hours with use of a ball mill, and the quantity of the electrostatic charge was measured with a blow-off electrostatic charge measuring apparatus (trademark "TB-200", manufactured by Toshiba Chemical Co., Ltd.) before and after the stirring.

Table 5 shows the results.

TABLE 4

| Example No. | Monomers | Molecular weight |
|---|---|---|
| Example 15 | 99% of I and 1% of II | 400,000 |
| Example 16 | 97% of I and 3% of II | 560,000 |
| Example 17 | 80% of III, 1% of IV and 19% of V | 350,000 |
| Example 18 | 90% of the copolymer of Example 15 and 10% of IV | |
| Comp. Ex. 5 | 100% of I | 400,000 |
| Comp. Ex. 6 | 70% of I and 30% of II | 200,000 |

(Note)
I: $CH_2{=}C(CH_3)COOCH_2CF_3$
II: $CH_2{=}C(CH_3)COOH$
III: $CH_2{=}CFCOOCH_2CF_3$
IV: $CH_2{=}CHCOOH$
V: $CH_2{=}CFCOOCH_3$
VI: Copolymer of vinylidene fluoride (trademark "VT-100", product of Daikin Kogyo Co., Ltd.)

TABLE 5

| Example No. | Initial value | After 200 hrs |
|---|---|---|
| Example 15 | +30 | +26 |
| Example 16 | +31 | +28 |
| Example 17 | +33 | +32 |
| Example 18 | +35 | +21 |
| Comp. Ex. 5 | +26 | +8 |
| Comp. Ex. 6 | +6 | +3 |

Table 5 shows that the carriers of the present invention are electrically charged more stably than those obtained in Comparison Examples 5 and 6.

EXAMPLE 19

A 15 g quantity of a polymer prepared from $CH_2{=}CClCOOCH_2CF_3$ ([η]=0.63, solvent: methyl ethyl ketone, temperature: 35° C.) was dissolved in 500 g of a solvent of a mixture of acetone/MEK (volume ratio=1/1), giving a coating solution.

With use of a curtain flow coater, 1 kg of ferrite powder (DSPR141, product of Dow Iron Powder Co., Ltd.) was coated with the solution. The coating layer had the thickness of 2 μm when dried.

To 100 parts by weight of the carrier formed with the obtained coating layer was added 2 parts by weight of the toner 10 μm in means particle size comprising 100 parts by weight of styrene/acryl copolymer (Hymer SBM73, product of Sanyo Chemical Industry, Ltd.), 10 parts by weight of carbon black (trademark "Regal 660R", product of Cabot Co., Ltd.) and 3 parts by weight of a low-molecular-weight polypropylene (trademark "Viscol 660R", product of Sanyo Chemical Industry, Ltd.), thereby producing a developer.

Into a 50 cc bottle provided with a screw cap was placed 50 g of the developer obtained, and the developer was stirred by a ball mill (type: V-1M, manufactured by Irie Shokai Ltd.) for 10 hours. The coating layer was observed with an electron microscope and exhibited no change.

On the other hand, when the developer was checked before the stirring with a blow-off electrostatic charge measuring apparatus (trademark "TB-200", manufactured by Toshiba Chemical Co., Ltd.), the quantity of the charge imparted to the toner was 36.6 μC/g. The quantity of the charge measured after stirring was 30.4 μC/g.

EXAMPLES 20 TO 24

Carriers were prepared by the same procedure as in Example 19 except that the polymer and the solvent to be used were replaced by each of the following polymers and solvents. Each carrier was checked for durability with the result that no peeling of the coating layer was found.

| | |
|---|---|
| Example 20: | |
| $CH_2{=}CClCOOCH_2CF_2CF_2H$ | 90 wt % |
| $CH_2{=}CClCOOCH_3$ | 10 wt % |
| ([η] = 0.58, MEK, 35° C.) | |
| Solvent: methyl cellosolve acetate | |
| Example 21: | |
| $CH_2{=}CClCOOCH_2CH_2(CF_2)_7CF_3$ | |
| ([η] = 0.38, methaxylenehexafluoride, 35° C.) | |
| Solvent: methaxylenehexafluoride | |
| Example 22: | |
| $CH_2{=}CClCOOCH_2CF_2CF_2H$ | 80 wt % |
| $CH_2{=}C(CH_3)COOCH_3$ | 20 wt % |
| ([η] = 0.35, MEK, 35° C.) | |
| Solvent: acetone/MEK = 1/1 | |
| Example 23: | |
| Polymer of Example 19 | 70 wt % |
| PMMA (trademark "ACRYPET MF", product of Mitsubishi Rayon Co., Ltd) | 30 wt % |
| Solvent: Acetone/MEK = 1/1 | |
| Example 24: | |
| Polymer of Example 19 | 50 wt % |
| Vinylidene fluoride/ethylene tetrafluoride copolymer (Vinilidene fluoride/ethylene tetrafluoride = 80/20 molar ratio) | 50 wt % |
| Solvent: Acetone/MEK = 1/1 | |

Given below is each quantity of the electrostatic charge imparted to the developers prepared with these carriers.

| Example No. | Initial value ($\mu$C/g) | Charge quantity after stirring ($\mu$C/g) |
|---|---|---|
| Example 20 | 29.2 | 26.1 |
| Example 21 | 12.3 | 10.9 |
| Example 22 | 20.7 | 15.7 |
| Example 23 | 17.3 | 14.3 |
| Example 24 | 33.8 | 28.8 |

COMPARISON EXAMPLE 7

A carrier was prepared by the same procedure as in Example 19 except that the polymer used was replaced by a copolymer of $CH_2{=}C(CH_3)COOCH_2CF_2CF_3$ and $CH_2{=}C(CH_3)COOCH_3$ (=70/30). The carrier was tested for durability with the result that the peeling of a portion of the coating layer was observed with use of SEM. The quantity of electrostatic charge imparted to the developer with the carrier was 23.8 $\mu$C/g before the stirring, but was found to markedly diminish to 13.8 $\mu$C/g after the stirring.

EXAMPLES 21 TO 30

Coating solutions (concentration: 2.5%) were prepared using the polymers and solvents as listed in Table 6

Thereafter a cluster of spherical iron particles (trademark "DSP141", product of Dowa Iron Powder Co., Ltd.) serving as a carrier core material was coated with the solution obtained above to a thickness of 2 $\mu$m on dry basis using a curtain flow coater (trademark "FL-mini", manufactured by Freund Industry, Ltd.), giving the carrier of the present invention.

TABLE 6

| Example No. | Monomer | Tg (°C.) | Solvent |
|---|---|---|---|
| 1 | (a) | 96 | MEK/Acetone (1/1) |
| 2 | (b) | 61 | MEK/Acetone (1/1) |
| 3 | (c) | 83 | MEK/Acetone (1/1) |
| 4 | (d) | 120 | MEK/Acetone (1/1) |
| 5 | (e) | 65 | MEK/Acetone (1/1) |
| 6 | (f) | 63 | MEK/Acetone (1/1) |
| 7 | (g) | 100 | Methyl isobutyl ketone |
| 8 | (h) | 124 | MEK |
| 9 | (i) | 92 | Methyl isobutyl ketone |
| 10 | (j) | 73 | Methyl isobutyl ketone |

(a) $CH_2{=}C(CH_3)COOCCF_2CF_2H$ ($CH_3$)

(b) $CH_2{=}C(CH_3)COOCH_2CF_2CFHCF_3$/MMA*
(weight ratio = 85:15)

(c) $CH_2{=}C(CH_3)COOC(CH_3)CF_2CFHCF_3$ (d) $CH_2{=}C(CH_3)COOCH_2C(CF_3)CH_3$/MA**
(weight ratio = 90:10)

TABLE 6-continued (e) $CH_2{=}C(CH_3)COOC(CH_3)(CF_2CF_2)_2H$ (f) $CH_2{=}C(CH_3)COOCH(CH_3)CF_2CFHCF_3$ (g) $CH_2{=}C(CH_3)COOC(CF_3)$ 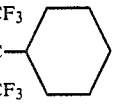

(h) $CH_2{=}C(CH_3)COOC(CF_3)$ 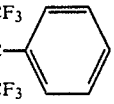

(i) $CH_2{=}C(CH_3)COOC(CF_3)H$/MMA*
(weight ratio = 90:10)

(j) $CH_2{=}C(CH_3)COOC(C_2H_5)CF_2CFHCF_3$

*MMA: $CH_2{=}C(CH_3)COOCH_3$
**MA: $CH_2{=}CHCOOCH_3$

COMPARISON EXAMPLES 8 AND 9

The same procedures as in Examples 21 to 30 were repeated except that the polymers and the solvents to be used were replaced with those shown in Table 7, producing comparative carriers.

TABLE 7

| Comp. Ex. No. | Monomers | Tg (°C.) | Solvent |
|---|---|---|---|
| 8 | A | 57 | 1,1,2-trichloro-1,2,2-trifluoroethane |
| 9 | B | 40 | Acetone/MEK (1/1) |

A: $CH_2{=}CHCOOCH_2CH_2C_9F_{19}$/MMA (weight ratio = 80:20)
B: $CH_2{=}C(CH_3)COOCH_2(CF_2CF_2)_2H$ On the other hand, a cluster of toner particles of a mean particle size of 11 $\mu$m was prepared by mixing together 100 parts by weight of styrene/n-butyl methacrylate polymer (weight ratio=80:20), 10 parts by weight of carbon black (trademark "Bicorustic D125", product of Cabot Co., Ltd.) and 3 parts by weight of a low-molecular-weight polypropylene (trademark "Viscol 660P", product of Sanyo Chemical Industry, Ltd.), kneading and grinding the resulting mixture and classifying the particles. A developer was produced by admixing 100 parts by weight of the carrier with 5 parts by weight of the toner obtained above with use of a twin-cylinder mixer.

The developer obtained was checked for the quantity of the electrostatic charge (Q/M, unit: $\mu$C/g) imparted to the toner using a blow-off electrostatic charge measuring device (trademark "TB-200", manufactured by Toshiba Chemical). Table 8 shows the results.

Then, the carrier was stirred by a ball mill for 200 hours and evaluated for durability by observing the surface thereof with an electron microscope. The results are shown in Table 8.

TABLE 8

| | Quantity of charge | Durability |
|---|---|---|
| Example 21 | +32 | A |
| Example 22 | +25 | A |
| Example 23 | +27 | A |
| Example 24 | +25 | A |
| Example 25 | +22 | A |
| Example 26 | +26 | A |
| Example 27 | +21 | A |
| Example 28 | +21 | A |
| Example 29 | +23 | A |
| Example 30 | +19 | A |
| Comp. Ex. 8 | +5 | C |
| Comp. Ex. 9 | +18 | B |

A: No change
B: A slight degree of scratches or peeling of the layer was found on the surface of the carrier.
C: A considerable degree of scratches or peeling of the layer was found on the surface of the carrier.

layer was found on the surface of the carrier.

As clear from Table 8, the carriers according to the invention can impart a large quantity of electrostatic charge to the toner and are excellent in durability in comparison with the carriers of Comparison Examples 8 and 9.

We claim:

1. A carrier for developing electrostatic images, the carrier comprising a core and a coating on the core, the coating being formed from a copolymer or a composition containing the copolymer, the copolymer comprising about 50 to about 99% by weight of a monomer represented by the formula

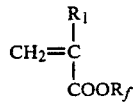

(a)

wherein $R_1$ is a hydrogen atom, a fluorine atom, a chlorine atom or a methyl group, and $R_f$ is a fluoroalkyl group, and about 50 to about 1% by weight of a monomer represented by the formula

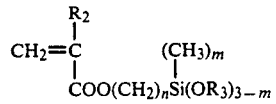

(b)

wherein $R_2$ is a hydrogen atom, a fluorine atom, a chlorine atom or a methyl group, $R_3$ is a methyl group, an ethyl group, a propyl group, a methoxyethyl group or an acetyl group, m is 0, 1 or 2 and n is an integer of 1 to 4.

* * * * *